US005195329A

United States Patent [19]

Lewis et al.

[11] Patent Number: 5,195,329

[45] Date of Patent: Mar. 23, 1993

[54] AUTOMATIC CHILLER PLANT BALANCING

[75] Inventors: Merrill A. Lewis, Syracuse, N.Y.; Paul W. James, Windsor, Conn.

[73] Assignee: Carrier Corporation, Syracuse, N.Y.

[21] Appl. No.: 790,859

[22] Filed: Nov. 12, 1991

[51] Int. Cl.[5] ..... F25B 5/00; F25B 7/00

[52] U.S. Cl. ..... 62/117; 62/175; 62/201; 62/230; 236/1 EA

[58] Field of Search ..... 62/117, 175, 201, 230; 236/1 EA, 1 E, 1 EB

[56] References Cited

U.S. PATENT DOCUMENTS

| | | | |
|---|---|---|---|
| 3,648,479 | 3/1972 | Richardson | 62/230 |
| 4,152,902 | 5/1979 | Lush | 236/1 EA |
| 4,210,957 | 7/1980 | Spethmann | 236/1 EA |
| 4,384,462 | 5/1983 | Overman et al. | 236/1 EA |
| 4,463,574 | 8/1984 | Spethmann et al. | 236/1 EA |
| 4,483,152 | 11/1984 | Bitondo | 62/175 |
| 4,487,028 | 12/1984 | Foye | 62/175 |
| 4,633,672 | 1/1987 | Persem et al. | 62/175 |
| 4,646,530 | 3/1987 | Huenniger | 62/230 |
| 4,656,835 | 4/1987 | Kidder et al. | 62/175 |
| 5,097,670 | 3/1992 | Yoshikawa et al. | 62/175 |

OTHER PUBLICATIONS

Ashrae Handbook 1983 Equipment published by ASHRAE 1791 Tullie Circle NE Atlanta Ga. 30329 pp. 18.2, 18.3, 18.11 (May 1983).

*Primary Examiner*—John K. Ford

[57] ABSTRACT

A method and control system for operating a chiller system having a lead compressor and a lag compressor in which the load on the compressors is balanced by limiting the % KW demand on the lag compressor from exceeding the 90 KW of the lead compressor while forcing the lag compressor to supply chilled water at a temperature lower than the lead compressor chilled water.

5 Claims, 1 Drawing Sheet

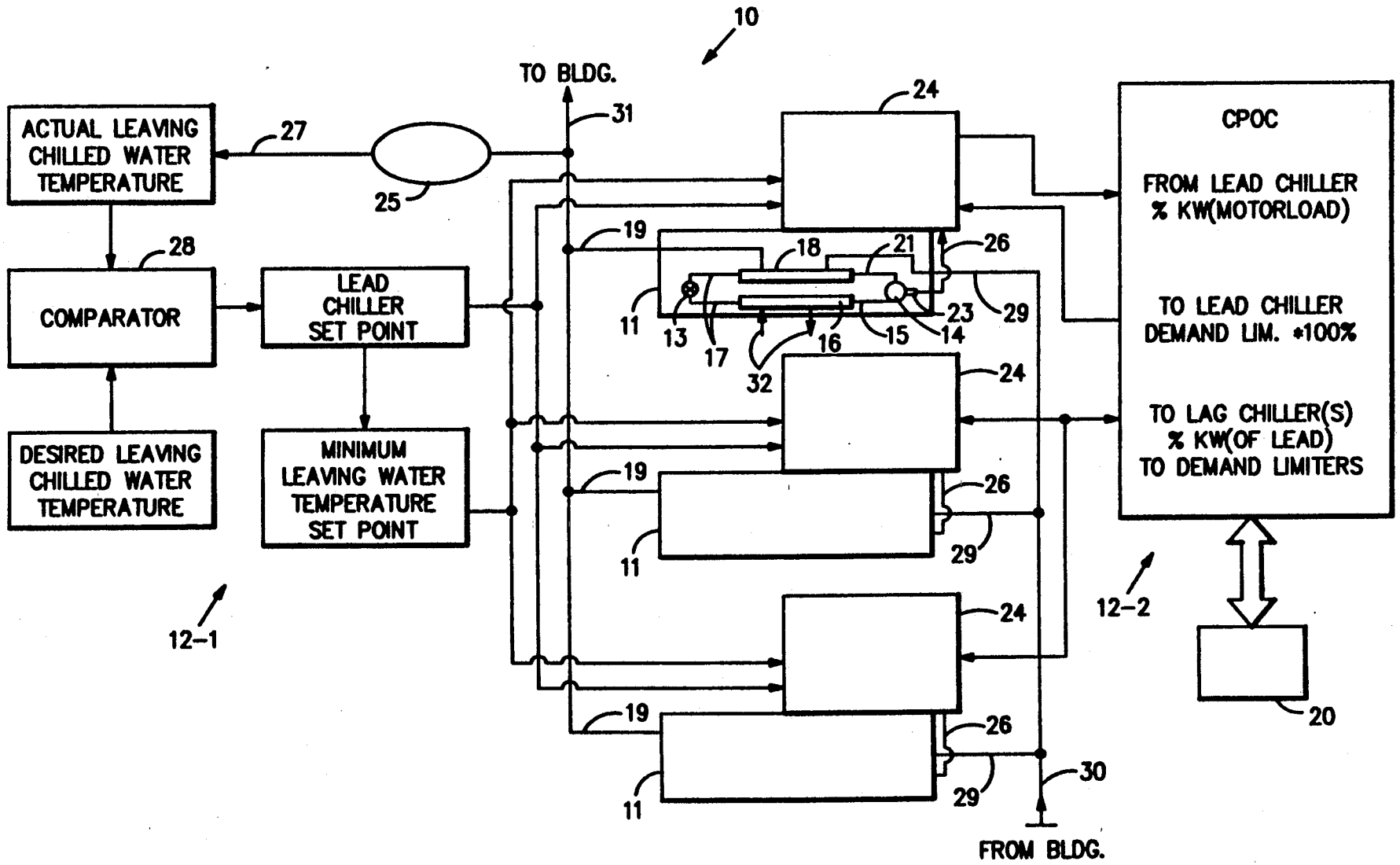
CPOC
FROM LEAD CHILLER % KW(MOTORLOAD)
TO LEAD CHILLER DEMAND LIM. *100%
TO LAG CHILLER(S) % KW(OF LEAD) TO DEMAND LIMITERS
20
12-2
30
FROM BLDG.
24
26
29
23
14
15
21
16
18
32
17
13
11
19
10
TO BLDG.
31
25
27
LEAD CHILLER SET POINT
MINIMUM LEAVING WATER TEMPERATURE SET POINT
ACTUAL LEAVING CHILLED WATER TEMPERATURE
28
COMPARATOR
DESIRED LEAVING CHILLED WATER TEMPERATURE
12-1

AUTOMATIC CHILLER PLANT BALANCING

BACKGROUND OF THE INVENTION

1. Field of the Invention

The present invention relates to methods of operating and controlling systems for air conditioning systems and, more particularly, to a method of operating and controlling a system for balancing the load of a plurality of chiller units in a chiller plant to improve the efficiency and reliability of the chillers.

2. Description of Related Art

Generally, large commercial air conditioning systems include a chiller which consists of an evaporator, a compressor, and a condenser. Usually, a heat transfer fluid is circulated through tubing in the evaporator thereby forming a heat transfer coil in the evaporator to transfer heat from the heat transfer fluid flowing through the tubing to refrigerant in the evaporator. The heat transfer fluid chilled in the tubing in the evaporator is normally water or glycol, which is circulated to a remote location to satisfy a refrigeration load. The refrigerant in the evaporator evaporates as it absorbs heat from the heat transfer fluid flowing through the tubing in the evaporator, and the compressor operates to extract this refrigerant vapor from the evaporator, to compress this refrigerant vapor, and to discharge the compressed vapor to the condenser. In the condenser, the refrigerant vapor is condensed and delivered back to the evaporator where the refrigeration cycle begins again.

To maximize the operating efficiency of a chiller plant, it is desirable to match the amount of work done by the compressor to the work needed to satisfy the refrigeration load placed on the air conditioning system. Commonly, this is done by capacity control means which adjust the amount of refrigerant vapor flowing through the compressor. The capacity control means may be a device for adjusting refrigerant flow in response to the temperature of the chilled heat transfer fluid leaving the coil in the evaporator. When the evaporator chilled heat transfer fluid temperature falls, indicating a reduction in refrigeration load on the refrigeration system, a throttling device, e.g. guide vanes, closes, thus decreasing the amount of refrigerant vapor flowing through the compressor drive motor. This decreases the amount of work that must be done by the compressor thereby decreasing the amount of power draw (KW) on the compressor. At the same time, this has the effect of increasing the temperature of the chilled heat transfer fluid leaving the evaporator. In contrast, when the temperature of the leaving chilled heat transfer fluid rises, indicating an increase in load on the refrigeration system, the throttling device opens. This increases the amount of vapor flowing through the compressor and the compressor does more work thereby decreasing the temperature of the chilled heat transfer fluid leaving the evaporator and allowing the refrigeration system to respond to the increased refrigeration load. In this manner, the compressor operates to maintain the temperature of the chilled heat transfer fluid leaving the evaporator at, or within a certain range of, a setpoint temperature.

Large commercial air conditioning systems, however, typically comprise a plurality of chillers, with one designated as the "Lead" chiller (i.e. the chiller that is started first and stops last) and the other chillers designated as "Lag" chillers. The designation of the chillers changes periodically depending on such things as run time, starts, etc. The total chiller plant is sized to supply maximum design load. For less than design loads, the choice of the proper combination of chillers to meet the load condition has a significant impact on total plant efficiency and reliability of the individual chillers. In order to maximize plant efficiency and reliability it is necessary to optimize the selection and run time of the chillers' compressors, and insure that all running compressors have equal loading. The relative electrical energy input to the compressor motors (% KW) necessary to produce a desired amount of cooling is one means of determining the balance of a plurality of running compressors. However, if the building load changes and the temperature of the chilled water supplied to the building from the chiller plant deviates from the desired chilled water setpoint, then the Lead chiller changes capacity, thus power draw also changes, to return the chilled water temperature to the set point. However, the lag compressors, in an attempt to maintain balance, also change capacity and overcompensate for the change in load, which in turn causes the Lead compressor to change capacity again. Accordingly, the desired balance among chillers in normally not attained. Thus, in the prior art chiller load balancing was normally left to chance. Each individual lag chiller would attempt to control its own discharge water temperature to a setpoint which was presumed to be the same as the lead chiller, but in fact could be subject to substantial variation and cause the relative % KW, or loading factor, of the operating chillers to vary correspondingly. Chillers usually operate most efficiently when they are near full load conditions. Having some chillers fully loaded while others are partially loaded, i.e. unbalanced, leads to inefficient system operation. Thus, there exists a need for a method and apparatus which balances the chiller loads and which minimizes the disadvantages of the prior control methods.

SUMMARY OF THE INVENTION

Therefore, it is an object of the present invention to provide a simple, efficient, and effective system for controlling the capacity of a refrigeration system in response to a change in load conditions while maintaining a relative KW balance between Lead and Lag compressors.

It is another object of the present invention to provide a balanced Lag chiller capacity that is controlled by a combination of leaving chilled water temperature setpoint and a demand (% KW) limit of the Lead chiller's compressor.

These and other objects of the present invention are attained by a Lead/Lag capacity balancing control system for a refrigeration system comprising means for generating a leaving chilled water setpoint signal corresponding to a desired master setpoint temperature for the heat transfer medium leaving the plant which is sent to the Lead compressor, means for generating a target leaving chill water setpoint signal which is below the desired master leaving chill water setpoint which is sent to all Lag chillers, and means for generating a % KW power draw signal of the Lead compressor which is sent to the Lag compressors to limit their relative power draw to no more than the lead compressor.

The compressor loads are balanced by limiting the Lag compressors to the % KW power draw (approximated by motor current) of the Lead compressor, and at the same time operating the Lead compressor to the desired master leaving chill water setpoint while operating the Lag compressors to the lower target leaving chill water setpoint. Accordingly, the Lag compressors are forced to attempt to provide leaving chilled water at the lower target leaving chilled water setpoint, which they are unable to accomplish because of the % KW demand limit imposed on them from the Lead compressor power draw limit, thus balancing the system.

BRIEF DESCRIPTION OF THE DRAWINGS

Still other objects and advantages of the present invention will be apparent from the following detailed description of the present invention in conjunction with the accompanying drawing, in which the reference numerals designate like or corresponding parts throughout the same, in which:

The FIGURE is a schematic illustration of a multiple compressor chilled water refrigeration system with a control system for balancing the relative power draw on each operating compressor according to the principles of the present invention.

DESCRIPTION OF THE PREFERRED EMBODIMENT

Referring to the FIGURE, a vapor compression refrigeration system 10 is shown having a plurality of chillers 11 with an operating control system for varying the capacity of the refrigeration system 10 according to the principles of the present invention. The system will be described using centrifugal compressors, although other types of compressors may be used. As shown in the FIGURE, the refrigeration system 10 includes a plurality of chillers 11 which consist of compressors 14, condensers 16, and evaporators 18. A chilled water supply line 19 supplies chilled water to the leaving water line 31 which flows to the spaces to be cooled. In operation, compressed gaseous refrigerant is discharged from the compressor 14 through compressor discharge line 15 to the condenser 16 wherein the gaseous refrigerant is condensed by relatively cool condensing water flowing through tubing 32 in the condenser 16. The condensed liquid refrigerant from the condenser 16 passes through the poppet valve 13, which forms a liquid seal to keep condenser vapor from entering the evaporator and to maintain the pressure difference between the condenser and the evaporator. The poppet valve 13 is in refrigerant line 17 between the condenser 16 and the evaporator 18. The liquid refrigerant in the evaporator 18 is evaporated to cool a heat transfer fluid, entering the evaporator through tubing 29 from the return chilled water line 30. The gaseous refrigerant from the evaporator 18 flows through compressor suction line 21 back to compressor 14 under the control of compressor inlet guide vanes (not shown). The gaseous refrigerant entering the compressor 14 through the guide vanes is compressed by the compressor 14 and discharged from the compressor 14 through the compressor discharge line 15 to complete the refrigeration cycle. This refrigeration cycle is continuously repeated during normal operation within each chiller 11 of the refrigeration system 10.

Each compressor has an electrical motor 23 controlled by the operating control system. The operating control system may include a chiller plant operating controller 12 (shown for convenience in the FIGURE as temperature controller 12-1 and motor controller 12-2), a local control board 24 for each chiller, and a Building Supervisor 20 for monitoring and controlling various functions and systems in the building. The temperature controller 12-1 receives a signal from temperature sensor 25, by way of electrical line 27, corresponding to the mixture temperature of the heat transfer fluid leaving the evaporators 18 through the tubing 19 and mixed in line 31, which is the chilled water supply temperature to the building. This leaving chilled water temperature is compared to the desired leaving chilled water temperature setpoint by a proportional/integral comparator 28 which generates a leaving chilled water temperature setpoint which is sent to the lead chiller.

Preferably, the temperature sensor 25 is a temperature responsive resistance devices such as a thermistor having its sensor portion located in the heat transfer fluid in the common leaving water supply line 31. Of course, as will be readily apparent to one of ordinary skill in the art to which the present invention pertains, the temperature sensor 25 may be any variety of temperature sensors suitable for generating a signal indicative of the temperature of the heat transfer fluid in the chilled water lines.

The operating control system 12 may be any device, or combination of devices, capable of receiving a plurality of input signals, processing the received input signals according to preprogrammed procedures, and producing desired output controls signals in response to the received and processed input signals, in a manner according to the principles of the present invention.

Further, preferably, the Building Supervisor 20 comprises a personal computer which serves as a data entry port as well as a programming tool, for configuring the entire refrigeration system and for displaying the current status of the individual components and parameters of the system.

Still further the local control board 24 includes a means for controlling a throttling control device for each compressor. The throttling control devices are controlled in response to control signals sent by chiller plant operating control module. Controlling the throttling device controls the KW demand of the electric motors 23 of the compressors 14. Further, the local control boards receive signals from the electric motors 23 by way of electrical line 26 corresponding to amount of power draw (approximated by motor current) as a percent of full load kilowatts (% KW) used by the motors.

During changes in load to a building the present system operates to balance the load on the operating compressors. When the system is started the initial or Lead compressor reduces or pulls down the chilled water temperature to a desired setpoint temperature. When the load increases and additional or Lag compressors are required to meet the demand the chiller loads among compressors are balanced by limiting the Lag compressors to the % KW power draw of the lead chiller while providing the Lag chillers with a target chilled water supply temperature setpoint, i.e. a predetermined temperature setpoint below the actual desired setpoint, and providing the Lead chiller with the actual desired chill water supply temperature setpoint. The lead chiller % KW demand is read, (for example every 10 seconds), by the chiller plant operating control and a corresponding signal is sent to each Lag chiller local control board. The % KW demand limit signal prevents a Lag chiller from exceeding the power draw of the Lead chiller. Further, the chilled water supply temperature setpoint signal is sent from the chiller plant operating control periodically, (for example every two minutes), to the Lead chiller local control board, and the target chilled water supply temperature setpoint signal is sent to each Lag chiller. Thus, the Lag chillers are forced to attempt to supply chilled water at the target chilled water supply temperature of the system, which they are unable to do because the % KW demand limit signal sent to each Lag chiller prevents them from drawing more power than the Lead chiller. Therefore, the motor current of all running chillers will be balanced.

While this invention has been described with reference to a particular embodiment disclosed herein, it is not confined to the details setforth herein and this application is intended to cover any modifications or changes as may come within the scope of the invention.

What is claimed is:

1. A method of operating a refrigeration system of the type having at least two compressors each having an electrical motor, wherein one compressor is selected as a lead compressor and the other compressor is selected a lag compressor, and an evaporator for each of the at least two compressors for cooling a heat transfer medium passing through each evaporator, comprising the steps of:

generating a lead compressor temperature signal which is a function of a lead compressor desired setpoint temperature;

generating a lag compressor temperature signal which is a function of a lag compressor desired setpoint temperature;

generating a lag compressor power draw limit signal which is a function of the lead compressor power draw; and controlling the lag compressor in response to the lag compressor power draw limit signal while the lag compressor attempts to maintain the desired lag compressor setpoint temperature.

2. A method of operating a refrigeration system as setforth in claim 1 wherein said generated lag compressor temperature signal is less than said generated lead compressor temperature signal.

3. A capacity balancing control system for a refrigeration system of the type including at least two compressors each having electrical motors, wherein one compressor is selected as a lead compressor and the other compressors are selected as lag compressors, and an evaporator for each of the at least two compressors for cooling a heat transfer medium passing through each evaporator, comprising:

means for generating a lead compressor temperature signal which is a function of a lead compressor desired setpoint temperature and for controlling the selected lead compressor to maintain the temperature of the medium leaving the evaporator of the selected lead compressor at the desired lead compressor setpoint temperature;

means for generating a lag compressor temperature signal which is a function of a lag compressor desired setpoint temperature, and for controlling the lag compressor to maintain the temperature of the medium leaving the evaporator of the lag compressor at the desired lag compressor setpoint temperature;

means for generating a lead compressor power signal which is a function of the power draw of the lead compressor; and a lag compressor power draw limit means for receiving the lead compressor power draw signal to limit the power draw of the lag compressor to said power draw of the lead compressor while the lag compressor attempts to maintain the desired lag compressor setpoint temperature.

4. A capacity balancing control system as set forth in claim 3 wherein said lag compressor desired setpoint temperature is less than said lead compressor desired set point temperature.

5. A capacity balancing control system as setforth in claim 4 wherein the lead compressor power signal is a function of the electrical current drawn by the motor of the lead compressor, and the power draw of the lag compressor is the electrical current drawn by the motor or the lag compressor.

* * * * *